US005264903A

United States Patent [19]

Nagame et al.

[11] Patent Number: 5,264,903

[45] Date of Patent: Nov. 23, 1993

[54] CLEANING UNIT WITH A CLEANING MEMBER MADE OF ACTIVATED CARBON FIBERS

[75] Inventors: Hiroshi Nagame; Narihito Kojima, both of Numazu, Japan

[73] Assignee: Ricoh Company, Ltd., Tokyo, Japan

[21] Appl. No.: 703,169

[22] Filed: May 20, 1991

[30] Foreign Application Priority Data

May 21, 1990 [JP] Japan ..... 2-129214
Sep. 6, 1990 [JP] Japan ..... 2-234383

[51] Int. Cl.[5] ..... G03G 21/00

[52] U.S. Cl. ..... 355/297; 15/256.52; 355/301

[58] Field of Search ..... 355/296, 297, 301; 15/256.5, 256.51, 256.52, 256.6

[56] References Cited

U.S. PATENT DOCUMENTS 3,768,902 10/1973 Van Dorn ..... 355/296
4,319,831 3/1982 Matsui et al. ..... 118/652 X
4,673,284 6/1987 Matsumoto et al. ..... 355/301
4,706,320 11/1987 Swift ..... 430/125 X

*Primary Examiner*—Leo P. Picard
*Assistant Examiner*—Christopher Horgan
*Attorney, Agent, or Firm*—Cooper & Dunham

[57] ABSTRACT

A cleaning unit for use in an image-formation apparatus including a photoconductor, provided with a cleaning member which can be brought into contact with the surface of the photoconductor and is made of an activated carbon fiber as the main component.

5 Claims, 5 Drawing Sheets

CLEANING UNIT WITH A CLEANING MEMBER MADE OF ACTIVATED CARBON FIBERS

BACKGROUND OF THE INVENTION

1. Field of the Invention

The present invention relates to a cleaning unit for use in an image-formation apparatus such as an electrophotographic copying machine, laser printer, facsimile machine, and the like, and more particularly to a cleaning unit capable of preventing the occurrence of image flow.

2. Discussion of Background

In an image-formation apparatus such as an electrophotographic copying machine, laser printer, facsimile machine, and the like, there are commonly used photoconductors comprising an electroconductive support and a photoconductive layer formed thereon comprising an inorganic photoconductive material such as an amorphous silicon (a-Si photoconductors), Se, As2Se3, SeTe and the like (Se photoconductors), or an organic photoconductive material such as poly-N-vinylcarbazole, trinitrofluorenone, and various types of azo dyes and the like (OPC photoconductors).

For example, an OPC photoconductor exhibits good electrical characteristics and spectral sensitivity, has a low manufacturing cost, is non-polluting, and can be formed into a photoconductor with a belt or drum shape with relative ease. It therefore finds many applications ranging from low-speed to medium-speed machines.

An a-Si photoconductor has an inferior charging performance in comparison with other photoconductors, but it has high sensitivity and excellent resistance to wear, so is utilized, for instance, in high-speed copying machines, and laser printers.

One example of an image-formation apparatus which uses this type of photoconductor is shown in FIG. 10. A photoconductor 1 is uniformly charged by a corona discharger 2. The corona discharger 2 may be a corotron type on which a 40 μm to 100 μm diameter tungsten wire is mounted, or a scorotron type in which, in addition, a grid is provided in the vicinity of an open section of a corona discharger in order to make the nonuniform discharges uniform, and a high voltage of 4000 to 8000 volts is applied. After a latent electrostatic image is formed on the photoconductor 1 in an exposure section 3, the latent electrostatic image is developed to a visible toner image by a development unit 4.

The toner image is transferred to a copy paper 9 by an image transfer corona charger 5, then the copy paper 9 is separated from the photoconductor 1 by a sheet-separation corona charger 6, is fixed to the copy paper 9 by an image-fixing unit 10, and turned into a hard copy. The toner image on the photoconductor 1 is cleaned after the image transfer by a cleaning unit 7 to complete a cycle of the copying process.

However, it is known that when the corona discharge takes place in the image-formation apparatus using the corona discharger, corona products, such as ozone and nitrogen oxides are produced, and when these corona products adhere to the surface of the photoconductor, the surface resistivity of the surface layer of the photoconductor is lowered and both the photosensitive characteristics of the photoconductor and the image quality characteristics deteriorate. In particular, the surface resistivity drops depending on the humidity and a blurred image is produced. In the worst case there is complete failure in the formation of the image. Accordingly, in order to maintain the initial image quality over a long period it is necessary to eliminate the effects of the corona products. In this type of blurred image, the degree of formation varies according to the material used to form the photoconductor, and in addition, there are differences in the materials which cause the image blurring to develop, but in all cases it is the corona products that trigger the development of the blurring.

The following factors are known to prevent the deterioration of the image characteristics caused by these types of corona products. As a first example, an improvement of the material itself from which the photoconductor is constructed is known to prevent a drop in the resistivity of the surface. In detail, this involves a material which forms a photoconductive layer on an electroconductive support member in the photoconductor, and a material further laminated on this photoconductive layer as a protective layer. In the case where the photoconductive layer and the protective layer are formed by a spray method or a coating method, an antioxidant, such as amine type or hydroxylamine type antioxidant, is added or rubbed in from the outside, to remove the effect of the corona products.

As a second example, it is known that the effect of ozone is eliminated by improving the corona charger itself, thereby restraining the production of the corona products, or by preventing the corona products from depositing on the photoconductor.

In the former, the charge wire and shielding casing or the grid are plated with a metal such as Au, Ag, Pt, Pd, Ni and Fe, or a metallic oxide such as $Ni_2O_3$, BaO, alumina, or chromium oxide, which serves as an agent for inhibiting the generation of ozone, whereby the development of corona products during the corona discharge process is restrained, as disclosed in Japanese Laid-Open Patent Applications 64-68774, 47-37547, 49-40739, and 49-84660, In the latter, for example, as disclosed in Japanese Laid-Open Patent Application 63-311365, the inner wall of the shielding casing or the grid is treated with activated carbon fiber or manganese oxide, or a metal chelate compound, and the corona products are absorbed to prevent their deposition on the photoconductor. In addition, other methods include forming the grid from an activated carbon fiber system, or attaching an absorption member, for example, as disclosed in Japanese Laid-Open Patent Application 1-210974, or adapting the shape of the shielding casing to take wind flow into account. Further, there is also the combination of plating the shielding casing with Pt or Ag and an absorption agent made from activated carbon, for example, as disclosed in Japanese Laid-Open Patent Applications 50-34828 and 52-133894.

As a third example, heating the photoconductor by a heater or drying with hot air to remove the effect of moisture, and use of a substance to prevent a drop in the resistivity of the surface of the photoconductor are also known, for example, as disclosed in Japanese Laid-Open Patent Applications 59-208558, 60-95467, 61-132977, and 62-262065.

As a fourth example, there is a method by which the corona products adhering to the surface of the photoconductor are physically removed by scouring or by wet cleaning. A steel wire wrapped around a roller or blade is used in the scouring method, as disclosed, for example, in Japanese Laid-Open Patent Application 1-161281, while, in the wet method, water or a solution is used to remove the corona products from the surface of the photoconductor.

Also, in addition to the fourth example, other methods for preventing image deterioration caused by the corona products are known, for example, as disclosed in Japanese Laid-Open Patent Applications 58-28581, 60-95459, 60-189769, 60-102659, 59-219770, 60-134254, 60-17765, and 55-155369.

In an image-formation apparatus such as that illustrated in FIG. 10, a corona discharge apparatus is used to perform the charging of the photoconductor, image transfer, and transfer-sheet separating operations, but corona products such as zone ($O_3$), and nitrogen oxides ($NO_x$), are produced by the corona discharger during corona discharge. As a result, these corona products are changed into nitrogen compounds or hydrophilic compounds including aldehyde group and/or carboxyl group, from the action of the discharge energy and of the moisture, carbon dioxide gas, and nitrogen gas in the air, so that the surface of the photoconductor is oxidized. Furthermore, the electric surface resistivity of the photoconductor is decreased because of the absorption of these compounds or moisture in the air so that the image flows or the copy quality is severely reduced, with widespread loss of the image because of the phenomenon by which blank spot-shaped sections appear.

This phenomenon has a strong influence in the case where an alternating current or a negative voltage is applied to the corona discharger. There are two types of phenomena which cause the image to disappear; a belt-shaped image loss produced under the corona discharger when the image-formation apparatus halts; and an image flow over the entire surface, which occurs in a highly humid atmosphere of 80–90% RH. These phenomena are produced more or less in most photoconductors, but, in the case of a photoconductor using a photoconductive layer made of an a-Si, a hydrophilic material such as $SiO_2$ is produced on the surface of the photoconductive layer, so that there is a tendency toward image flow. Also, the same type of problem occurs with a photoconductor using a protective layer of a - C : H, which is considered to be superior in not only durability but also weather resistivity, as with an a - Si photoconductor.

With this type of photoconductor, the severity of the image flow increases as the humidity increases and can extend over the entire image.

When an As2Se3 photoconductor is used alone, the problem of image flow does not occur, but if an overcoat layer of an organic resin such as an ester or an urethane crosslinked-type of styrene - methyl methacrylate resin in which ultrafine particles of $SnO_2$, $SnO_2/Sb_2O_3$ or $TiO_2$ are dispersed is used, it is known that a severe image flow occurs. Such an image-flow-producing process varies according to the structure of the photoconductor, but in all cases the existence of the corona products is the cause.

This phenomenon is not produced when the photoconductor is new, but after repeated use of the photoconductor in an image-formation apparatus, this phenomenon conspicuously occurs. This is because after repeated use of the photoconductor, the surface becomes soiled and the water repellency thereof decreases, so that the absorptivity of the dirt is increased and hydrophilic materials tend to remain on the surface. Most of the dirt adhering to the photoconductor cannot be removed by a cleaning blade or a simple cleaning means so the effect of the dirt remains for a long time.

SUMMARY OF THE INVENTION

Accordingly, an object of the present invention is to provide, with due consideration to the drawbacks of such conventional means, a cleaning unit for use in an image-formation apparatus, comprising a cleaning member which can be brought into contact with a photoconductor and is capable of effectively preventing image flow produced in an image-formation apparatus.

The above object of the present invention can be achieved by a cleaning unit for use in an image-formation apparatus, comprising a cleaning member which can be brought into contact with a photoconductor of the image-formation apparatus and consists essentially of an activated carbon fiber.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3(*b*) is a partial perspective view of a further cleaning tool for use in the cleaning unit of the present invention;

FIG. 4(*b*) is a schematic, partially cut-away perspective view of the cleaning tool shown in FIG. 4(*a*);

FIG. 7(*b*) is a schematic cross-sectional view of the cleaning tool shown in FIG. 7(*a*);

DESCRIPTION OF THE PREFERRED EMBODIMENTS

Figure 1:
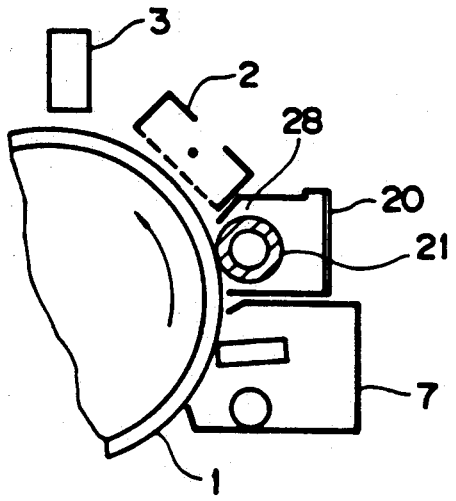
FIG. 1 is a schematic transverse cross-sectional view of an imaging-formation apparatus provided with an example of a cleaning unit of the present invention.

The present invention will now be explained with reference to the accompanying drawings. FIG. 1 schematically partly shows an imaging-formation apparatus provided with an example of a cleaning unit according to the present invention. In the figure, reference numeral 1 indicates a photoconductor, which may be, for example, an OPC photoconductor, an a-Si photoconductor, or a selenium photoconductor. On the photoconductor 1, there may be provided a protective layer which is an amorphous silicon-based thin-film such as an a-C:H layer, an a-SiN:H layer, or an a-SiC:H layer, or an organic thin-film layer in which a resistivity control agent or the like has been dispersed.

Reference numeral 2 indicates a scorotron type corona discharger, on which a grid is provided. In the scorotron type corona discharger 2, for example, when an OPC photoconductor for negative charging is used, a negative charge system must be used, but if the corona discharger discharges a negative charge, corona products which cause image flow are produced in large amounts and the degree of soiling of the photoconductor is considerable.

Reference numeral 3 indicates an exposure section. In the case of a laser printer, an image from an LED with a wavelength of 750 to 820 nm is projected through the exposure section 3 onto the photoconductor 1, while in the case of an analogue type image formation apparatus or some digital type electrophotographic copying machines, light images formed via a lens by a halogen lamp or a fluorescent lamp are projected onto the photoconductor 1 through the exposure section 3.

Reference numeral 7 indicates a cleaning unit, which is provided for cleaning the toner image after image transfer. Reference numeral 20 indicates another cleaning unit which cleans the corona products adhering to the photoconductor after the toner image cleaning. A cleaning tool 21 in the cleaning unit 20 rotates in the same direction as the photoconductor 1. Reference numeral 28 indicates a brush which is provided to prevent dust from the cleaning unit 20 from entering the corona discharger 2.

Figure 2:
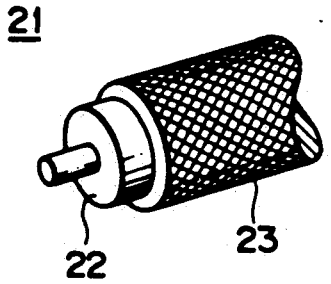
FIG. 2 is a partial perspective view of a cleaning tool of the above example of the cleaning unit.

FIG. 2 is a perspective view of one part of the cleaning tool 21 used in the cleaning unit 20 shown in FIG. 1. The cleaning tool 21 comprises a support member 22 and a cleaning member 23. The support member 22 is made from a metal, such as aluminum or steel, compressed paper, or a plastic product such as vinyl chloride or polycarbonate. the like. The support member 22 may take the form of a hollow cylinder. The cleaning member 23 is formed mainly from an activated carbon fiber, preferably with a fiber diameter in the 5 to 30 μm range. This activated carbon fiber is produced from a raw material such as a cellulose, a polyacrylonitrile fiber, phenol resin, or pitch. Of these materials, the polyacrylonitrile is the best for producing a activated carbon fiber which is superior with respect to the absorption and decomposition of the corona products such as ozone, and $NO_x$. The external surface of the cleaning member 23, which comes into direct contact with the photoconductor 1, may be made of the activated carbon fiber, or may be protected by a netting of a mesh diameter of about 0.5 to 2 mm, but a higher cleaning effect is obtained from direct contact between the photoconductor and the activated carbon fiber and by a surface with a higher content of the activated carbon fiber.

With the cleaning member 23, a laminated structure is also suitable. The activated carbon fiber may be used in many forms. For example, an activated carbon fiber in felt form of a thickness of 1 to 3 mm (for example, Fineguard felt made by Toho Rayon Co., Ltd.) is provided on the support member 22, and then an activated carbon fiber in textile form of a thickness of 0.5 to 1 mm (for example, Fineguard textile made by Toho Rayon Co., Ltd.) is mounted thereon.

Other examples of the cleaning member 23 are (1) an activated carbon fiber in textile form applied to a cotton felt or a foamed material with a Japanese Industrial Standards (JIS) hardness between 50 degrees and 80 degrees, and (2) a polyester or nylon protective netting material of a mesh diameter of 0.5 to 2 mm provided on the activated carbon fibers in felt form.

The cleaning member consisting essentially of such an activated carbon fiber is preferably formed of a material cut to a width of 3 to 15 mm and flocked by electrodeposition, for example, Flockysheet (made by Toho Rayon Co., Ltd.). The material in this form on a sheet of, for example, nylon or polyester or the like, with a fiber length of 2 mm or less and preferably about 1 mm, because activated carbon fiber is easily broken, flocked by electrodeposition, is wound onto the support member 22 in loop form at a 2 to 5 mm spacing, as shown in FIG. 3(*a*).

Figure 3A:
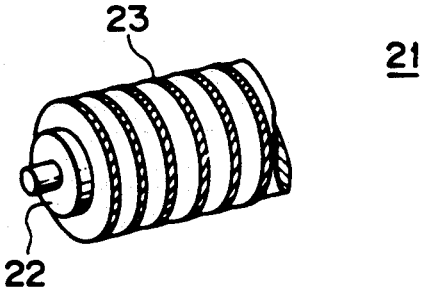
FIG. 3(*a*) is a partial perspective view of another cleaning tool for use in the cleaning unit of the present invention.
Figure 3B:
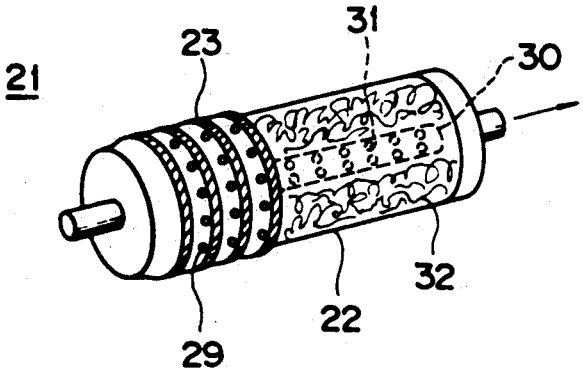
Figure 4A:
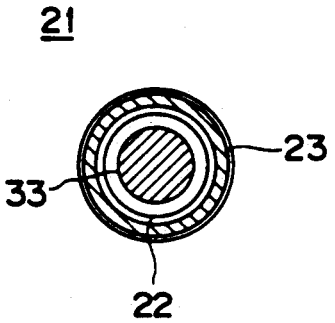
FIG. 4(*a*) is a schematic cross-sectional view of still another cleaning member for use in the cleaning unit of the present invention.
Figure 4B:
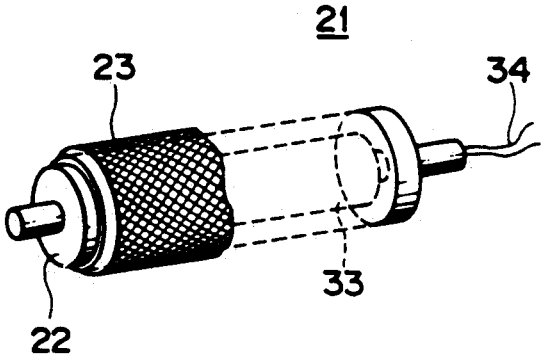

FIG. 3(*b*) shows a cleaning tool 21 which is highly effective in absorbing the corona products. A plurality of 1 to 5 mm diameter ventilation holes 29 perforate the hollow support member 22 in a looped pattern. A scavenger member 32 is provided for absorbing both ozone and $NO_x$ which pass through the ventilation holes 29, and for adsorbing the corona products scoured from the surface of the photoconductor. The scavenger member 32 is made from activated carbon in either felt or mat form with good gas permeability. A pipe 31 is provided for forming the ventilation holes 30, but no particular shape is required for these holes. The pipe 31 is connected to an exhaust gas system (not shown) to improve the absorption efficiency. Furthermore, by making the cleaning tool 21 being of activated carbon fiber in a loop shape, the cleaning efficiency can be significantly improved with avoidance of non-uniform cleaning. This is particularly advantageous in an image-formation apparatus with a high copying speed. In addition, as will be later described, a constant, stable image is obtained by the provision of a heating means 33 for heating the cleaning member 23 as illustrated in FIG. 4(*a*) and FIG. 4(*b*). The heating means 33 may be provided within a roller for supporting the cleaning member 23 or directly under the cleaning member 23. External heating is also acceptable.

In these examples of the present invention, by cleaning with a cleaning member which consists essentially of activated carbon fiber, while maintaining contact with the photoconductor, the corona products adhering to the surface of the photoconductor are cleaned with good efficiency, and, in addition, the dust and surrounding corona products scoured away are also absorbed, so that the soiling of the photoconductor is light and good image quality can be maintained.

FIG. 4(*a*) and FIG. 4(*b*) are respectively a schematic cross-sectional view and a schematic, partially cutaway perspective view of another preferred example of the cleaning tool 21 for use in the cleaning unit 20 of the present invention. In this cleaning tool 21, a heating means 33 is provided for heating the photoconductor to approximately 35° C. to 55° C., and may be a rod-shaped heater or a resistor material applied to a cylinder. The temperature of the heating means is controlled according to the surface temperature of the photoconductor.

Reference numeral 23 indicates a cylindrical support member for the cleaning tool 21. The cylindrical support member 23 is made from, for example, hardened aluminum or stainless steel about 0.5 to 2 mm thick, and may also be perforated with holes 0.5 to 4 mm in diameter.

In the above cleaning tool 21, by cleaning with a cleaning member which consists essentially of activated carbon fiber, while maintaining contact with the photoconductor, the corona products adhering to the surface of the photoconductor can be cleaned with good efficiency, and at the same time, by elevating the temperature using a built-in heat source, no image deterioration occurs even with a severe change in humidity.

By providing this built-in heat source within the support member for the cleaning member, more effective use is made of the space and because the cleaning member is always dry during use, there is no reduction in the cleaning effect because of absorbed moisture.

It is preferable for the cleaning member to always be in contact with the photoconductor. When there are corona products adhering to the photoconductor, the shorter the time they remain the better is the degree of cleaning. If left standing for a long time, the quality of the surface of the photoconductor degenerates and the cleaning power drops. The cleaning tool 21 rotates in the same direction as the photoconductor 1 and it is preferable that its relative linear speed not be the same as that of the photoconductor for good cleaning.

Figure 5:
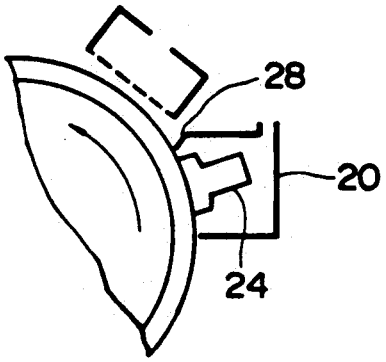
FIG. 5 is a schematic transverse cross-sectional view of an image formation apparatus provided with another example of a cleaning unit of the present invention.

FIG. 5 is a schematic transverse cross-sectional view of an image formation apparatus provided with another example of a cleaning unit of the present invention. This cleaning unit is of a slide-contact type and is provided with a cleaning tool 24.

Figure 6:
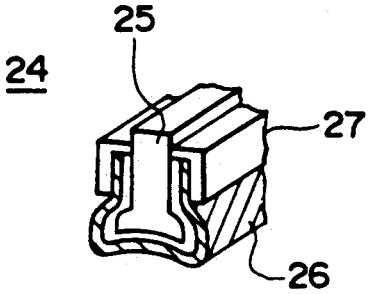
FIG. 6 is a partial perspective view of a cleaning tool used in the cleaning unit shown in FIG. 5.

FIG. 6 is a partial perspective view of the cleaning tool 24 shown in FIG. 5. In this cleaning unit, a support member 25 is provided for a cleaning member 26 which is the same as the cleaning member 23 shown in FIG. 2. A presser fitting 27 is provided for the cleaning member 26. Although not shown in the figures, a belt-type of cleaning member can also be used.

Figure 7A:
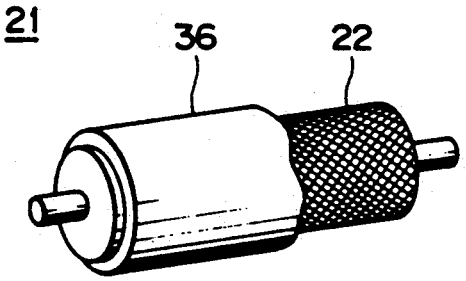
FIG. 7(*a*) is a partially cut-away perspective view of another cleaning tool of the present invention.
Figure 7B:
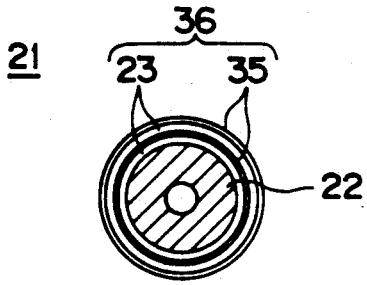

FIG. 7(*a*) is a partially cut-away perspective view of another preferred cleaning tool according to the present invention, and FIG. 7(*b*) is a schematic cross-sectional view of the cleaning tool in FIG. 7(*a*). The cleaning tool 21 comprises (1) a sheet 36 consisting of an activated carbon fiber 23 which is laminated on a non-woven fabric 35 and (2) a roller-type support member 22 around which the sheet 36 is wound. The activated carbon mounted in this manner on the roller-type support member 22 adequately fulfils the function of removing materials adhering to the photoconductor, but after it has been used for a long period, the activated carbon fiber becomes fragile and inevitably problems are produced with respect to its durability against wear. For this reason, a method by which the activated carbon fiber is soaked with a reinforcing agent, a method by which a reinforcing material is combined with the activated carbon fiber in mixed spinning, and a method by which the side of the activated carbon fiber in contact with the photoconductor is covered with a protective material, can be proposed.

In the method by which the activated carbon fiber is soaked with a reinforcing agent, and the method of mixed spinning with a reinforcing material such as nylon, polyester, the area of contact at which the activated carbon fiber contacts the photoconductor is small, so that the cleaning effect decreases, and because the cleaning member hardens, there is a tendency for the surface of the photoconductor to be damaged.

In the method in which the active carbon fiber is covered with a protective material, a nylon or polyester netting of a mesh diameter of about 0.2 to 2 mm with a thread diameter of 50 to 200 5m is usually used. However, as with the previously discussed methods, the photoconductor is subject to damage, or the contact ratio for the activated carbon fiber and the photoconductor decreases so that the effective cleaning can possibly worsen, therefore the conditions of use are restricted. Also, the protective material will break down, depending on the material used, producing problems in durability.

As the protective material used in the present invention, a non-woven fabric which is loosely woven from a very fine fiber of polyester, polyethylene, or polypropylene, or the like with a fiber diameter of about 1 to 20 5m is suitable. However, this is not restricted to a non-woven fabric if the objects of the invention are met.

The roller support member 22 on which these materials are mounted may be made of paper, metal, or resin and the like. The roller should have an irregular surface with depressions of about 1 to 2 /mm, to prevent the material from slipping. When air is to be exhausted through the cleaning member, air exhaust holes are provided over the entire surface of the support member.

The cleaning member of the cleaning unit 20 rotates in the same direction as the photoconductor 1. The rotation ratio is adjusted to 1/5 to 1/10 of that of the photoconductor 1.

Figure 8:
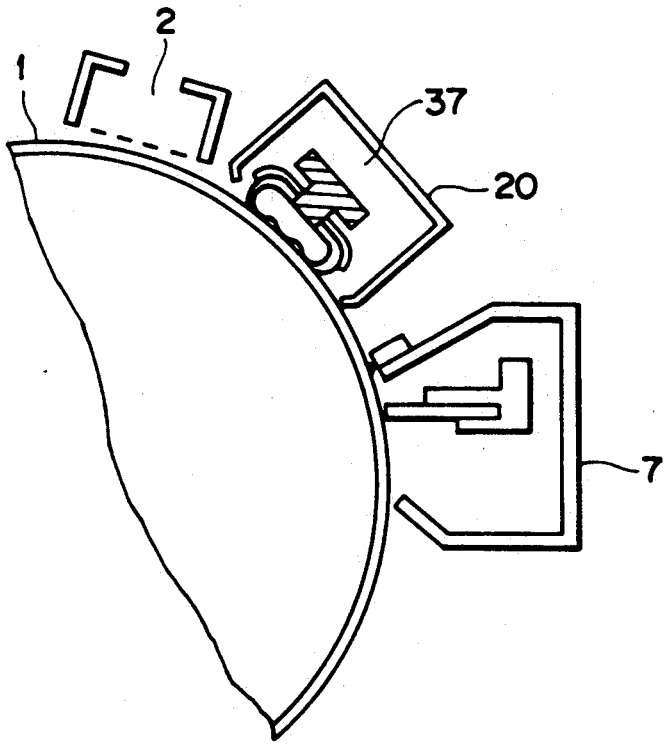
FIG. 8 is a schematic transverse cross-sectional view of yet another example of a cleaning unit of the present invention.
Figure 9:
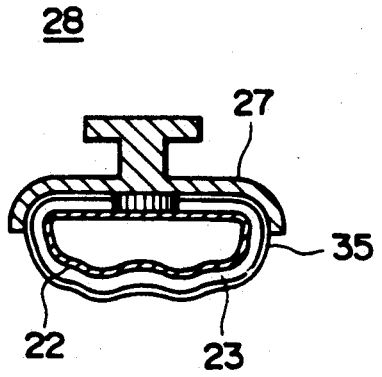
FIG. 9 is a schematic cross-sectional view of the cleaning tool used in the cleaning unit of the present invention shown in FIG. 8.
Figure 10:
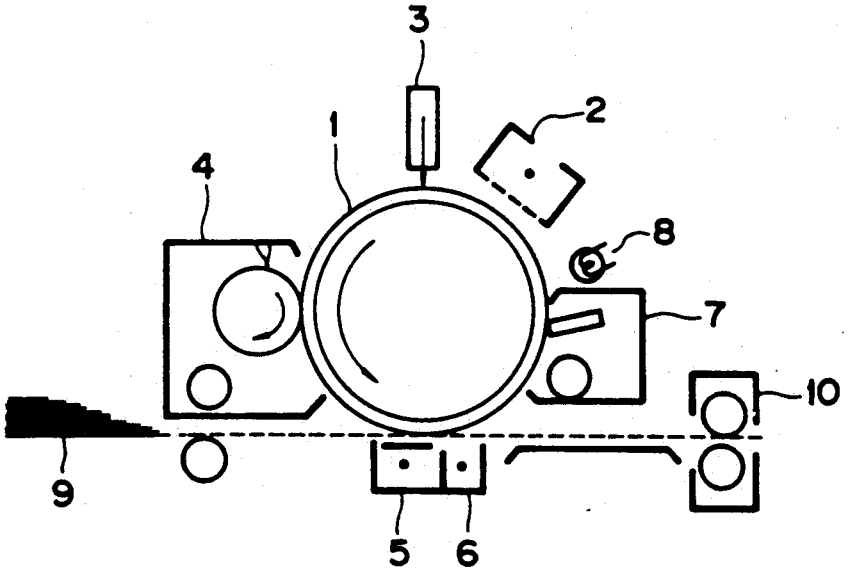
FIG. 10 is a schematic cross-sectional view of an example of an image-formation apparatus.

FIG. 8 shows yet another example of a cleaning unit according to the present invention in which a fixed cleaning tool 37 is used. FIG. 9 is a schematic cross-sectional view of the cleaning tool 37 shown in FIG. 8. Activated carbon fiber 23 is arranged on a mounting jig 22 and covered with a non-woven fabric 35 in the same manner as shown in FIG. 7(*b*). It is preferable that the support member 22 used in this embodiment have some elasticity, and the side facing the photoconductor be of plastic 1 to 2 mm thick. It is, however, also possible to use a member made of paper or metal. The side of the mounting jig 22 facing the photoconductor is made in a wave shape with the spacing between the peaks and valleys 1 to 4 mm. A wave shape is used to improve the effectiveness of the cleaning by spreading the area of contact to avoid one-point contact.

The pressure at which the cleaning member contacts the photoconductor varies according to the shape of the cleaning member. When a felt-type activated carbon fiber is used, the effect of a small amount of the fiber in powder form is large. The cleaning unit should preferably be driven by a drive device which is activated at the same time the main switch for the image-formation apparatus is thrown. During the standby period awaiting conditions to proceed with the copying operation, it is possible to remove the corona products adhering to the surface of the photoconductor directly under the corona discharge apparatus. In addition, although the cleaning member is operated so that it is always in contact with the photoconductor, but, if necessary, it can be released. Next, the operation and effect of the cleaning unit of the present invention will be described with reference to the following examples:

EXAMPLE 1

A photoconductor 1 formed by laminating an a-C:H layer of a 7500 to 8000Å film thickness and a Knoop hardness of 1500 to 2000 kg/mm$^2$ on an OPC photoconductor by the plasma CVD method was mounted on an experimental laser beam printer.

A cleaning member 23 comprising a felt-type activated carbon fiber (Fineguard Felt FE-200) with, for example, a specific surface area of 700 $m^2/g$ and a basis weight of 100 $g/m^2$ on which was laid a wove activated carbon fiber (Fineguard Woven Fabric FW-210) of a specific surface area of 700 $m^2/g$ was formed on the support member 22 of the cleaning tool 21 shown in FIG. 2 or FIG. 6.

A cleaning unit 20 was set so that the cleaning member 23 or 26 contacted the photoconductor. A light contact pressure was sufficient, so that there was uniform contact with the activated carbon fiber. The cleaning tool 21 shown in FIG. 2 was rotated in the same direction as the photoconductor with a difference in the comparative linear speeds of the two rotating members providing for slippage between the two. Rotation of the cleaning tool 21 at a speed two or three times, or even greater, that of the photoconductor was found to most effectively remove the corona products.

The laser printer was run for 5 days, printing 3000 sheets per day in an atmosphere of 55 to 60% RH and 21° C. to 25° C. The image was checked at the beginning and end of each copy run. When runs were made without the cleaning unit 20, after 3000 copies were made and allowed to stand overnight the phenomenon of blank sections was produced with loss of the image in a band at the surface opposite the negative charging corona discharge apparatus, and at high relative humidities of 80 to 85% flowing of the image occurred.

However, when the cleaning unit 20 according to the present invention was used, the above-mentioned type of phenomenon did not occur, and after 150,000 copies had been printed no problems were encountered for all practical purposes. In addition, very few scratches from scouring appeared on the surface of the photoconductor and the images were completely free of scratches.

EXAMPLE 2

A photoconductor 1 formed by laminating an a-C:H layer of a 7500 to 8000Å film thickness and a Knoop hardness of 1500 to 2000 $kg/mm^2$ on an OPC photoconductor by the plasma CVD method was mounted on a laser beam printer.

The cleaning tool shown in FIG. 3(*a*) and the cleaning tool shown in FIG. 3(*b*) were respectively installed with an activated carbon fiber Flockysheet (commercially available from Toho Rayon Co., Ltd.) uniformly secured in contact with the photoconductor. The linear speeds of the photoconductor 1 and the cleaning tool 21 were then set so that the cleaning tool rotated at about four times as fast as the photoconductor. In the case of the cleaning tool in FIG. 3(*b*), a fan with a maximum delivery of 0.2 $m^3$/min under standard conditions was connected for ventilation.

Specifically, after 3000 to 4000 copies of an A-4 size sheet were run without the cleaning unit 20 shown in this example and allowed to stand for six or seven hours, the phenomenon of blank sections was produced with loss of the image in a band at the surface opposite the negative charging corona discharge apparatus, and at high relative humidities of 80 to 85%, flowing of the image occurred.

However, in the case where the highly effective cleaning tool shown in FIG. 3(*a*) was used, no practical problems were encountered up to 10,000 copies, and with the cleaning tool of FIG. 3(*b*) 20,000 copies were made with no problems.

This test was also run using an N-type photoconductor with an a-Si:H type photoconductive layer laminated to about 40 μm on an electroconductive support member, and almost the same results were obtained. However, a certain amount of thickening of characters was observed, and symptoms of image flow were produced. Application of heat from the cleaning member easily counteracted the image flow.

EXAMPLE 3

A photoconductor 1 formed by laminating an a-C:H layer of a 7500 to 8000Å film thickness and a Knoop hardness of 1500 to 2000 $kg/mm^2$ on an OPC photoconductor by the plasma CVD method was mounted on an experimental laser beam printer.

The cleaning unit 20 was formed from a cleaning member 23 comprising a felt-type activated carbon fiber (Fineguard Felt FE-200) with a specific surface area of 700 $m^2/g$ and a basis weight of 100 $g/m^2$, and a woven activated carbon fiber (Fineguard Woven Fabric FW-210) of a specific surface area of 700 $m^2/g$, on a 1 mm thick, hardened aluminum cylinder and was provided with a rod-shaped 10 W heater 33 as a heat source, as shown in FIGS. 4(*a*), 4(*b*).

The cleaning unit 20 was set so that the cleaning member 23 contacted the photoconductor. A light contact pressure was sufficient, so that there was uniform contact with the activated carbon fiber.

The cleaning tool of the cleaning unit was rotated in the same direction as the photoconductor with a difference in the comparative linear speeds of the two rotating members providing for slippage between the two. Rotation of the cleaning tool at a speed two to ten times that of the photoconductor was found to most effectively remove the corona products.

With constant cleaning the resistance to image flow was widely improved, and a level was reached at which there were no problems in practice. When the cleaning effect deteriorated the built-in cleaner heater was activated as an auxiliary means. This built-in heater is particularly effective against the phenomenon of blank sections which is in particular produced on a surface facing a negative corona discharge apparatus or an AC corona discharge apparatus on an OPC photoconductor with an a-C:H layer as a protective film, or an a-Si photoconductor, as shown in this example, when a severe change in humidity occurs. Other advantages are that the cleaning member is always dry, and the space saving is possible.

There is a non-woven fabric using an ultrafine fiber of polyester which is said as being highly effective as a cleaning member. However, in this particular example, the results were very poor as almost no effect was obtained.

Heat may be applied to the photoconductor when a certain amount of drop in the cleaning effect occurs, but it is preferable that heat be applied from the start, beginning when the main switch is thrown. The photoconductor is heated to 40° to 45° C.

When the cleaning unit of this example was not used, after running 3000 to 4000 copies and allowing to stand for 6 to 7 hours, the phenomenon of blank sections was produced with loss of the image in a band at the surface opposite the negative charging corona discharge apparatus. Also, flowing of the image occurred at high relative humidities of 80 to 85%.

However, with the method of this example, there was no occurrence of this type of phenomenon, and 20,000 copies were made with good effect.

EXAMPLE 4

A photoconductor formed by laminating an a-C:H layer of a 8500 to 10,000μ film thickness and a Knoop hardness of 800 to 1200 kg/mm$^2$ on an 80 mm diam OPC photoconductor by the plasma CVD method was mounted on an experimental laser beam printer (10 ppm).

A cleaning member 21 as shown in FIG. 8, was formed from a felt-type activated carbon fiber (Fineguard Felt FE-200) with a specific surface area of 700 m$^2$/g and a basis weight of 100 g/m$^2$ on which was laminated a non-woven fabric of the Japanese paper type processed from a polyester fiber of a 2 to 4 μm diameter, formed by four-fold wrapping on a 20 mm diameter support member. The surface of the support member was roughened using about a #240 emory paper.

The cleaning member 21 fabricated in this manner was mounted on the cleaning unit 20 between the toner cleaning unit 7 of FIG. 1 and the charger 2. The linear speed of the rotating cleaning member was set at three times that of photoconductor.

The laser beam printer set in this manner was run for a total of 10 days, printing 3000 sheets per day in an atmosphere of 64 to 70% RH and 21° C. to 25° C. The image was checked at the beginning and end of each copy run.

For comparison purposes the cleaning unit 20 was removed and the printing results evaluated. When runs were made without the cleaning unit 20, after 6000 copies were made and allowed to stand overnight the phenomenon of blank sections was produced with loss of the image in a band at the surface opposite the negative charging corona discharge apparatus, and flowing of the image occurred at high relative humidities of 80 to 85%.

However, with the method shown in this example, this type of phenomenon did not occur over the 10 days of tests. In addition, almost no decrease in film thickness was observed.

EXAMPLE 5

A plastic product processed in a wave shape with an interval of about 3 mm between the peaks and valleys was mounted on an aluminum plate 5 mm thick. The felt-type activated carbon fiber of the fourth embodiment was built up in four folds on the wave-shaped plastic, and a non-woven fabric built up in two folds and restrained with a clasp, to obtain the cleaning member shown in FIG. 4.

This cleaning member was mounted on the same laser beam printer used in Example 4 and image evaluation carried out over a period of 10 days. The results showed no deterioration in the image quality, and, for all practical purposes, no reduction occurred in the film thickness of the photoconductor. In addition, no damage was observed in the non-woven fabric, but there was evidence of wear on the activated carbon fiber at the peaks of the support member. However, it was not necessary to replace this material.

According to the present invention, by cleaning with a cleaning member which consists essentially of activated carbon fiber, always in contact with the photoconductor, the corona products adhering to the surface of the photoconductor can be removed with good efficiency with the minimum of damage to the surface of the photoconductor. As a result, the soiling of the photoconductor is light and good image quality can be maintained for a long time.

What is claimed is:

1. A cleaning unit for use in an image-formation apparatus including a photoconductor, comprising a cleaning member which can be brought into contact with the surface of said photoconductor and consists essentially of an activated carbon fiber.

2. The cleaning unit as claimed in claim 1, further comprising a cleaning unit for cleaning toner remaining on said photoconductor.

3. The cleaning unit as claimed in claim 1, wherein the activated carbon fiber of said cleaning member is covered with an activated carbon fiber protective member.

4. The cleaning unit as claimed in claim 1, wherein said cleaning member is formed as a roller, wound in a loop-shape around a member on which said activated carbon fiber has been flocked by electrodeposition.

5. The cleaning unit as claimed in claim 1, further comprising a heating means for heating said cleaning member.

* * * * *